US008328615B2

(12) United States Patent
Parham

(10) Patent No.: US 8,328,615 B2
(45) Date of Patent: Dec. 11, 2012

(54) THREE WAY WIN POKER

(76) Inventor: Tyler T Parham, Reno, NV (US)

( * ) Notice: Subject to any disclaimer, the term of this patent is extended or adjusted under 35 U.S.C. 154(b) by 115 days.

(21) Appl. No.: 13/026,818

(22) Filed: Feb. 14, 2011

(65) Prior Publication Data

US 2011/0201398 A1 Aug. 18, 2011

Related U.S. Application Data

(60) Provisional application No. 61/303,678, filed on Feb. 12, 2010.

(51) Int. Cl.
*A63F 9/24* (2006.01)

(52) U.S. Cl. ..... 463/13; 273/292; 463/16

(58) Field of Classification Search ..... 463/13; 273/292
See application file for complete search history.

*Primary Examiner* — Omkar Deodhar
(74) *Attorney, Agent, or Firm* — Nwamu, P.C.; Fidel D. Nwamu

(57) ABSTRACT

The present invention h designed to allow a player to play multiple hands of electronic video poker. The player places the proper wager and initiates game play (e.g.. selects deal) and a 1$^{st}$ (primary) poker hand (e.g.. 5 cards) is dealt face up. At this time the player has the option to select (i.e.. hold) zero or one or more cards from the primary poker hand. If the player selects or holds one or more cards from the primary game, the selected cards are duplicated into the same positions of each additional poker hands to be played by the player. In the present invention, during play of the game, replacement cards are dealt for each of the duplicated cards in the additional (2$^{nd}$, 3$^{rd}$, etc.) poker hands.

20 Claims, 1 Drawing Sheet

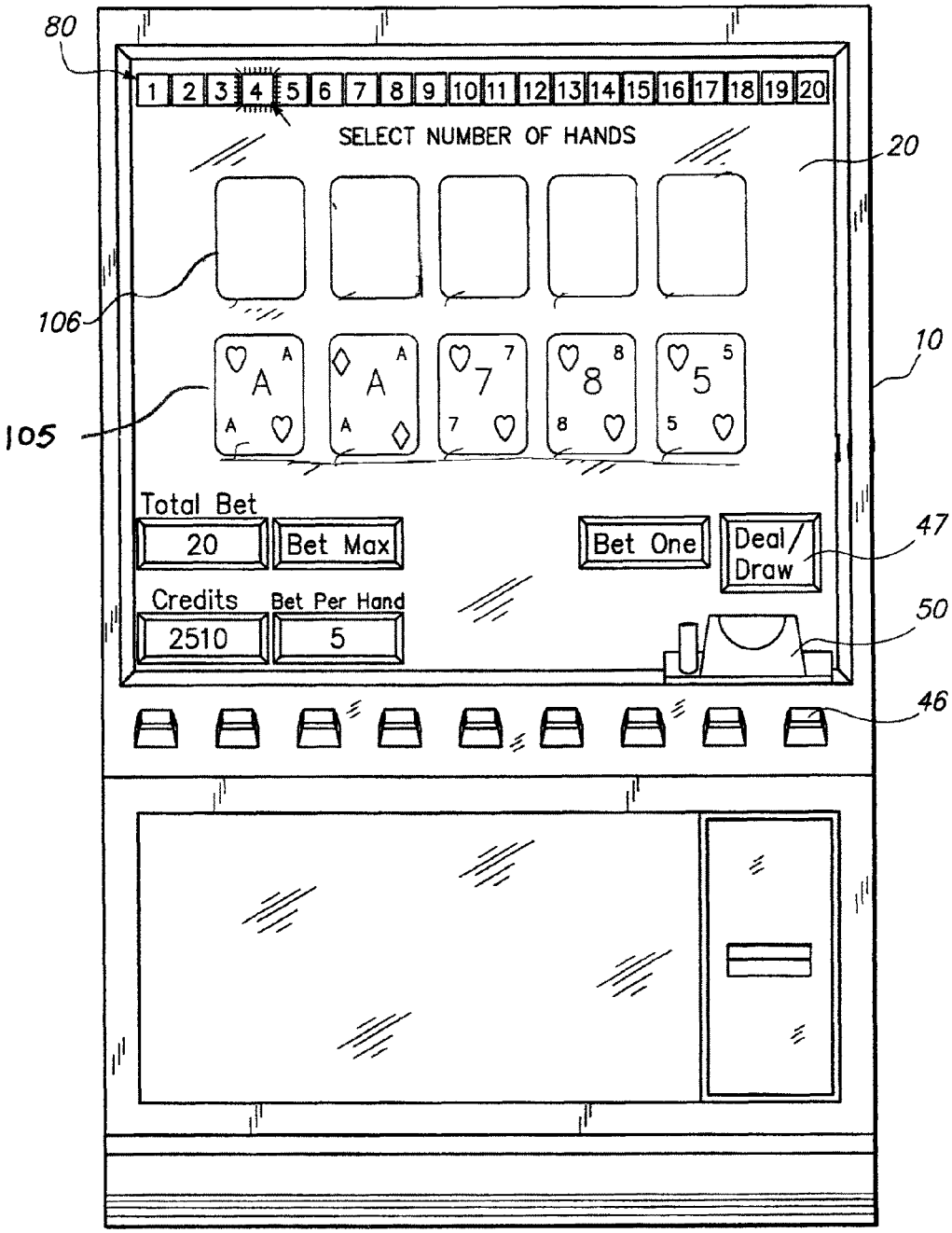
80
1 2 3 4 5 6 7 8 9 10 11 12 13 14 15 16 17 18 19 20
SELECT NUMBER OF HANDS
20
106
10
105
Total Bet
20
Bet Max
Bet One
Deal/ Draw
47
Credits
Bet Per Hand
2510
5
50
46

THREE WAY WIN POKER

CLAIM OF PRIORITY

The present invention claims priority from U.S. Provisional Patent Application No. 61/303,678, entitled Three Way Win Poker filed Feb. 12, 2010, the specification of which is hereby incorporated as if fully set forth in the present specification.

BACKGROUND OF THE INVENTION

This invention relates primarily to multi-hand electronic video poker games, and more particularly to electronic video poker games that provide multiple winning opportunities not provided in traditional multi-hand poker games such as in pending patents application Ser. Nos. 10/108,845, 09/633,479 and U.S. Pat. Nos. 6,652,377, 6,098,985, 6,007,066, 5,823,873, 5,732,950, 5,531,448 and any other related applications in which cards are duplicated from an initial hand of cards into one or more additional hands to allow the player the opportunity to play one or more cards from the starting hand of cards multiple times.

BRIEF SUMMARY OF THE INVENTION

The method of the present invention involves a card game in which the player plays multiple poker hands. The player makes a wager for each poker hand and each poker hand becomes a separate poker hand to be played by the player. A $1^{st}$ (primary) poker hand of two, three, four or five cards is dealt all face up (e.g., five cards) and the same numbers of cards are dealt face down for each additional ($2^{nd}$, $3^{rd}$, etc. poker hand selected to be played. After the deal, the player selects none, one or more of the face up cards from the primary poker hand as cards to be held. The cards that are held in the primary poker hand are duplicated into the same positions of all the additional poker hands on top of the face down cards previously dealt.

After the player selects draw, replacement cards for the non-selected cards are dealt into the first hand and all the face down cards in the additional hands that do not have a duplicated face up card on top of them, are turned over to complete the additional poker hands. Typically in prior art video poker video games, at this time the poker hand ranking of each poker hand is determined and the player is paid for any winning poker hands based on a predetermined pay table and the amount of the player's wager.

Unlike the prior art, the gaming device's computing system which has been previously programmed, determines if one of the face down cards beneath one of the duplicated face up cards can be used to improve the existing poker hand in each of the additional poker hands. If the gaming device's computing system determines that one or more of the additional poker hands may be improved by replacing one or more of the duplicated face up cards with one or more of the face down cards beneath them, the gaming device's computing system will replace one or more of the duplicated face up card with one or more of the face down card beneath them to improve any of the additional poker hand rankings. After the gaming device's computing system determines to improve any of the additional poker hand or not, the poker hand ranking of each poker hand is determined and the player is then paid for any winning poker hands based on a pay table and the amount of the player's wager.

BRIEF DESCRIPTION OF THE DRAWINGS

FIG. 1 illustrates an electronic video poker machine for use with an exemplary embodiment of the present invention.

DETAILED DESCRIPTION OF THE INVENTION

The present invention includes a variety of electronic video poker games each having multiple poker hands, each hand being e.g., a five card poker hand, in which the player selects zero, one or more cards from a $1^{st}$ (primary) poker hand; and the selected cards are duplicated into the same positions of each of the additional poker hands (e.g., $2^{nd}$ poker hand, $3^{rd}$ poker hand, etc poker hand).

FIG. 1 illustrates electronic video poker machine 10 for use with an exemplary embodiment of the present invention. Electronic video poker machine 10 comprises a game screen 20 on which a plurality of poker hands such as the first hand 105 and second hand 106 can be displayed. Wagers can be accepted by slot 50 and the desired number of hands can be wagered by selecting number of hands button 80. Console deal/draw button 46 or deal/draw button 47 on game screen 20 can be used to deal and/or draw as proves necessary.

In one or more embodiments of the present invention, during play of the game, replacement cards are dealt for each of the duplicated cards in each of the additional poker hands. This may be done at different times and ways depending on the embodiment being implemented. For example, in one embodiment, every time a player selects a card to be held in the primary poker hand and it is duplicated in the additional poker hands, a replacement card is dealt for the duplicated card and may be placed underneath the duplicated card. In another embodiment replacement cards may also be dealt underneath the $1^{st}$ or primary poker hand.

Each electronic video poker game is designed to be played by having the poker hands displayed on a video screen to a player. By manipulating the buttons on the button panel of the gaming device or by using conventional touch screen technology, the player selects which cards from the primary poker hand he wishes to play and duplicate into the additional poker hands and which cards he wishes to discard. The player activates a draw button and cards are dealt and displayed for the discarded cards in the primary hand and cards are dealt into the additional poker hands in order to complete the poker hands (e.g., five card poker hands). After the cards in all the poker hands are face up, the gaming device's computing system determines if any of the additional poker hands can be improved by any of the replacement cards beneath the face up duplicated cards. Also in embodiments where replacement cards are dealt underneath the held cards in the primary poker hand, the computing system would also determine if the primary poker hand could be improved by any of the replacement cards dealt underneath the held cards in the primary poker hand.

If the replacements cards can improve the poker hands of the primary or additional poker hands, the gaming device's computing system replaces the face up duplicated cards with the replacements cards beneath them. The resulting completed hands are analyzed for poker hand ranking and the outcome of the play of each hand is determined. The player wins awards based on the poker hand rankings of the completed hands and the amount wagered by the player on each hand using a pay table that is displayed to the player.

In another embodiment of the present invention, a separate deck of cards is used for each poker hand (or row) of cards that the player wishes to play. For example, in a game where a player plays three poker hands or rows, a standard fifty-two deck of cards is used for each of the poker hands. The player initiates game play (e.g., selects Deal) and a 1st (primary) poker hand is dealt (e.g., 2 of clubs, 3 of clubs, 8 of spades, 4 of clubs and 5 of spades) face up using a first standard fifty-two card deck while the $2^{nd}$ (additional) poker hand is dealt (e.g., 2 of spades, 8 of hearts, Ace of clubs, 5 of hearts and 5 of clubs) face down using a second deck of forty-seven cards which comprises a standard fifty-two card deck having the player's five initial face up cards shown in the first hand omitted therefrom and the $3^{rd}$ (additional) poker hand of cards is dealt (e.g., 4 of hearts, 6 of clubs, 4 of diamonds, 9 of clubs and 4 of spades) using a third deck of forty-seven cards which comprises a standard fifty-two card deck having the player's five initial face up cards shown in the first hand omitted therefrom.

This may be accomplished using the computer controls that operate the gaming machine with the software being written so that the $2^{nd}$ and $3^{rd}$ decks used to deal the $2^{nd}$ and $3^{rd}$ (additional) poker hands, respectively, have removed therefrom the five cards initially dealt.

| Primary Poker Hand dealt face up | | | | | | |
|---|---|---|---|---|---|---|
| $1^{st}$ poker hand | 2 of clubs, | 3 of clubs, | 8 of spades, | 4 of clubs | and | 5 of spades |
| Additional Poker Hands dealt face down | | | | | | |
| $2^{nd}$ poker hand | 2 of spades, | 8 of hearts, | Ace of clubs, | 5 of hearts | and | 5 of clubs |
| $3^{rd}$ poker hand | 4 of hearts, | 6 of clubs, | 4 of diamonds, | 9 of clubs | and | 4 of spades |

In one embodiment of the present invention, the player has the option to make one, two or three wagers: the first wager is on the $1^{st}$ primary poker hand, the second wager is on the $2^{nd}$ additional poker hand and the third wager is on the $3^{rd}$ additional poker hand. Thus, the player is playing one, two or three hands at a time. Alternatively, it could be mandatory that the player must wager on all three hands.

The player selects those cards in the primary poker hand that he wishes to hold. The player effects this selection by pressing buttons or, using touch screen technology, by simply pressing the cards on the screen that the player wishes to hold. Each card that is held (e.g., held cards—2 of clubs, 3 of clubs, 4 of clubs and 5 of clubs) by the player from the primary poker hand is duplicated in the corresponding vertically aligned position in both the additional poker hands ($2^{nd}$ poker hand) and ($3^{rd}$ poker hand). Therefore, three copies of the held card are now displayed on the screen. The player may hold from zero to five cards from the primary poker hand.

| Primary Hand | | | | | | |
|---|---|---|---|---|---|---|
| $1^{st}$ Poker Hand | 2 of clubs, | 3 of clubs, | Not Held, Additional | 4 of clubs | and | 5 of spades |
| $2^{nd}$ Poker Hand | 2 of clubs, | 3 of clubs, | Not Duplicated, | 4 of clubs | and | 5 of spades |
| $3^{rd}$ Poker Hand | 2 of clubs, | 3 of clubs, | Not Duplicated, | 4 of clubs | and | 5 of spades |

After the player is satisfied with his selection of replacement cards, the player presses the "draw" button and one or more cards not held in the $1^{st}$ (primary) poker hand (e.g., 8 of spades) are replaced with another card (e.g., 7 of hearts) using the remaining cards from the first standard card deck. In this embodiment, where the cards are not duplicated from the primary hand the face down cards are used in the $2^{nd}$ (Additional) poker hand (e.g., Aces of Clubs) and the $3^{rd}$ (Additional) poker hand (e.g., 4 of diamonds) to complete the additional poker hands.

| Primary Hand | | | | | | |
|---|---|---|---|---|---|---|
| 1st Poker Hand | 2 of clubs, | 3 of clubs, | Draw Card 7 of hearts, | 4 of clubs | and | 5 of spades |
| Additional Hands | | | | | | |
| 2nd Poker Hand | 2 of clubs, | 3 of clubs, | Draw Card Ace of clubs, | 4 of clubs | and | 5 of spades |
| 3rd Poker Hand | 2 of clubs, | 3 of clubs, | Draw Card 4 of diamonds, | 4 of clubs | and | 5 of spades |

After the player selects draw and all the cards in the poker hands are showing face up, the gaming device's computing system determines if any of the additional poker hands can be improved by any of the face down cards beneath the face up duplicated cards. For example, in the 2nd additional hand, since there is a 5 of clubs face down (dealt faced down from initial deal discussed above) beneath the 5 of spades duplicated card, then the 5 of spades duplicated card can be replaced with the 5 of clubs card in order to improve the 2nd poker hand from a straight to a straight flush. And in the 3rd additional poker hand, since there is a 4 of hearts face down under the 2 of clubs duplicated card, the 2 of clubs duplicated card can be replaced with the 4 of hearts card and there is a 4 of spaces face down under the 5 of spaces, the 5 of spades duplicated card can be replaced with the 4 of spades card to improve the 3rd additional poker hand from nothing to a four of a kind.

| Primary Hand | | | | | | |
|---|---|---|---|---|---|---|
| 1st Poker Hand | 2 of clubs, | 3 of clubs, | 7 of hearts, | 4 of clubs | and | 5 of spades |
| Additional Hand | | | | | | |
| 2nd Poker Hand | 2 of clubs, | 3 of clubs, | Ace of clubs, | 4 of clubs | and | Replaced 5 of clubs |
| 3rd Poker Hand | Replaced 4 of hearts, | 3 of clubs, | 4 of diamonds, | 4 of clubs | and | Replaced 4 of spades |

The resulting completed hands are analyzed for poker hand ranking and the outcome of the play of each hand is determined. The player wins awards based on the poker hand rankings of the completed hands and the amount wagered by the player on each hand using a pay table that is displayed to the player. Alternatively, the method of the present invention can also be applied to three card poker or four card poker. Each row is treated as a separate hand for payout purposes. Each row is evaluated for poker hand ranking and the player is paid based on the amount of his wager on each row depending on the poker hand ranking achieved for that poker hand/row.

In another embodiment of the present invention, the method of the invention may be used as a bonus for the original multi-hand game. In this embodiment a separate deck of cards may be used for each poker hand (or row) of cards that the player wishes to play. For example, in a game where a player plays at least two poker hands or rows, a standard fifty-two deck of cards is used for each of the poker hands. The player initiates game play (e.g., selects Deal) and a 1st (primary) poker hand is dealt (e.g., 2 of clubs, 3 of clubs, 8 of spades, 4 of clubs and 5 of spades) face up using a first standard fifty-two card deck while the 2nd (additional) poker hand is dealt (e.g., 2 of spades, 8 of hearts, Ace of clubs, 5 of hearts and 5 of clubs) face down using a second deck of forty-seven cards which comprises a standard fifty-two card deck having the player's five initial face up cards shown in the first hand omitted there from.

This may be accomplished using the computer controls that operate the gaming machine with the software being written so that the 2nd deck used to deal the 2nd (additional) poker hand, respectively, have removed there from the five cards initially dealt.

| Primary Poker Hand dealt face up | | | | | | |
|---|---|---|---|---|---|---|
| 1st poker hand | 2 of clubs, | 3 of clubs, | 8 of spades, | 4 of clubs | and | 5 of spades |
| Additional Poker Hands dealt face down | | | | | | |
| 2nd poker hand | 2 of spades, | 8 of hearts, | Ace of clubs, | 5 of hearts | and | 5 of clubs |

In this embodiment of the present invention, the player may have the option to make a first wager on the 1st primary poker hand and a second wager on the 2nd additional poker hand and the player may also be able to wager on the bonus hand opportunity for the first and second hands. The wagers for the first hand and the bonus hand opportunity for the first hand maybe combined and the same for the second hand and the bonus hand for the second hand. Alternatively, it could be mandatory that the player must wager on all hands and bonus opportunities. In other multi-hand embodiments the primary hand bonus hand opportunity may or may not be initiated.

The player selects those cards in the primary poker hand that he wishes to hold. The player effects this selection by pressing buttons or, using touch screen technology, by simply pressing the cards on the screen that the player wishes to hold. Each card that is held (e.g., held cards—2 of clubs, 3 of clubs, Not Held, 4 of clubs and 5 of spades) by the player from the primary poker hand is duplicated in the corresponding vertically aligned position in the additional poker hand ($2^{nd}$ poker hand). Therefore, two copies of the held card are now displayed on the screen. The player may hold from zero to five cards from the primary poker hand.

| Primary Hand | | | | | | |
|---|---|---|---|---|---|---|
| $1^{st}$ Poker Hand | 2 of clubs, | 3 of clubs, | Not Held, | 4 of clubs | and | 5 of spades |
| | | | Additional | | | |
| $2^{nd}$ Poker Hand | 2 of clubs, | 3 of clubs, | Not Duplicated, | 4 of clubs | and | 5 of spades |

After the player is satisfied with his selection of replacement cards, the player presses the "draw" button and one or more cards not held in the $1^{st}$ (primary) poker hand (e.g., 8 of spades) are replaced with another card (e.g., 7 of hearts) using the remaining cards from the first standard card deck. In this embodiment, where the cards are not duplicated from the primary hand the face down cards maybe used in the $2^{nd}$ (Additional) poker hand (e.g., Aces of Clubs) to complete the additional poker hand.

| Primary Hand | | | | | | |
|---|---|---|---|---|---|---|
| | | | Draw Card | | | |
| $1^{st}$ Poker Hand | 2 of clubs, | 3 of clubs, | 7 of hearts, | 4 of clubs | and | 5 of spades |
| | | | Additional Hands | | | |
| | | | Draw Card | | | |
| $2^{nd}$ Poker Hand | 2 of clubs, | 3 of clubs, | Ace of clubs, | 4 of clubs | and | 5 of spades |

After the player selects draw and all the cards in the poker hands are showing face up, the gaming device's computing system may deals replacement card beneath all the cards held (if any) in the primary hand using the remaining cards from the first standard card deck.

| Primary Hand | | | | | | |
|---|---|---|---|---|---|---|
| | | | Draw Card | | | |
| $1^{st}$ Poker Hand | 2 of clubs, | 3 of clubs, | 7 of hearts, | 4 of clubs | and | 5 of spades |
| Replacement cards dealt underneath held cards in the primary hand | | | | | | |
| | 6 of clubs | 6 of hearts | none | 6 of spades | and | 6 of diamonds |

(Depending on how the poker game is programmed the replacement card may be dealt before or after the gaming device's computing system analyzes each hand for winning combinations and pays or any time a programmed after cards in the primary hand are held).

The resulting completed hands are analyzed for poker hand ranking and the outcome of the play of each hand is determined (e.g., primary poker hand no winning combination, $2^{nd}$ poker hand straight winning combination received). The player wins awards based on the poker hand rankings of the completed hands and the amount wagered by the player on each hand using a $1^{st}$ pay table that is displayed to the player.

After the played hands are analyzed for any winning combination and pays, the gaming device's computing system determines if the primary hand and any of the additional poker hands played can be improved by any of the face down cards beneath the face up duplicated cards or the dealt cards beneath the held face up cards of the primary hand. For example, in the $1^{st}$ primary hand the held 2 of clubs can be replaced with the 6 of clubs dealt beneath it, the 3 of clubs can be replaced with the 6 of hearts dealt beneath it, the 4 of clubs can be replaced with the 6 of spades dealt beneath it and the 5 of spades can be replaced with the 6 of diamonds dealt beneath it improving the primary hand from nothing to a four of a kind and the $2^{nd}$ additional hand, since there is a 5 of clubs face down (dealt faced down from initial deal discussed above) beneath the 5 of spades duplicated card, then the 5 of spades duplicated card can be replaced with the 5 of clubs card in order to improve the $2^{nd}$ poker hand from a straight to a straight flush.

| Primary Hand | | | | | | |
|---|---|---|---|---|---|---|
| 1st Poker Hand: | Replaced 6 of clubs, | Replaced 6 of hearts, | 7 of hearts, | Replaced 6 of spades | and | Replaced 6 of diamonds |
| Additional Hand | | | | | | |
| 2nd Poker Hand: | 2 of clubs, | 3 of clubs, | Ace of clubs, | 4 of clubs | and | Replaced 5 of clubs |

The resulting completed bonus hands are analyzed for poker hand ranking and the outcome of the play of each hand is determined. The player wins awards based on the poker hand rankings of the completed hands and the amount wagered by the player on each hand using a $2^{nd}$ pay table that is displayed to the player. Alternatively, the method of the present invention can also be applied to three-card poker or four-card poker. Each row is treated as a separate hand for payout purposes. Each row is evaluated for poker hand ranking and the player is paid based on the amount of his wager on each row depending on the poker hand ranking achieved for that poker hand/row.

In a further embodiment, the method of the present invention may be used to convert any existing single hand poker game into a multi-hand poker game or the method of the present invention can be implemented on any existing multi-hand poker game in order to create more winning combinations and increase player return.

In each of the preferred embodiments of the present invention, a standard fifty-two card deck of playing cards is used for each deck. One or more cards may also be designated as wild cards and, alternatively, one or more Jokers may be added to the deck of cards and the Jokers are used as wild cards. In each of the preferred embodiments of the present invention, the amount of the player's wager on each hand would be the same. Alternatively, the player could be allowed to make wagers of different amounts on each hand or one wager for all the hands played. Note that during the play of the game, replacements cards are dealt for each of the duplicated cards in each of the additional poker hands. This may be done at different time and ways.

For example, in the method of the present invention, a primary poker hand is dealt face up and the player selects zero, one or more cards from a primary poker hand, and if one or more cards are selected, the selected cards are duplicated into the same positions of each of the additional poker hands. In one or more embodiments of the present invention, replacement cards for the duplicated cards may be dealt into the additional poker hands face down.

This may be done during and/or after the deal as is described above or during and/or after the draw. For example, in a after the draw scenario, when the cards for the primary poker hand are dealt face up, card backs may be used to identify the additional 5 card poker hands. When the player selects one or more cards from a primary poker hand, the selected cards are duplicated into the same positions of each card backs in each of the additional poker hands. When the player selects draw replacement cards are then dealt face up for the discarded cards and at the same time card are dealt underneath the duplicated cards.

After the player selects draw and all the cards in the poker hands are dealt face up, the gaming device's computing system determines if any of the additional poker hand can be improved by any of the face down cards beneath the face up duplicated cards. The resulting completed hands are analyzed for poker hand ranking and the outcome of the play of each hand is determined. The player wins awards based on the poker hand rankings of the completed hands and the amount wagered by the player on each hand using a pay table that is displayed to the player.

Although the description has been described with respect to particular embodiments thereof, these particular embodiments are merely illustrative, and not restrictive. Any suitable programming language can be used to implement the routines of particular embodiments including C, C++, Java, assembly language, etc. Different programming techniques can be employed such as procedural or object oriented. The routines can execute on a single processing device or multiple processors. Although the steps, operations, or computations may be presented in a specific order, this order may be changed in different particular embodiments. In some particular embodiments, multiple steps shown as sequential in this specification can be performed at the same time.

Particular embodiments may be implemented in a computer-readable storage medium or tangible medium for use by or in connection with the instruction execution system, apparatus, system, or device. Particular embodiments can be implemented in the form of control logic in software or hardware or a combination of both. The control logic, when executed by one or more processors, may be operable to perform that which is described in particular embodiments.

Particular embodiments may be implemented by using a programmed general purpose digital computer, by using application specific integrated circuits, programmable logic devices, field programmable gate arrays, optical, chemical, biological, quantum or nanoengineered systems, components and mechanisms may be used. In general, the functions of particular embodiments can be achieved by any means as is known in the art. Distributed, networked systems, components, and/or circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

I claim:

1. A method for playing multiple hands of video poker, said method comprising:

dealing a first poker hand with three or more cards face-up and a second poker hand with three or more cards face-down;

selecting a hold card from the first poker hand;

duplicating the hold card from the first poker hand into a duplicate hold card, wherein said duplicate hold card is placed over a similarly positioned face-down card of the second poker hand;

replacing non-held cards of the first poker hand and turning face-up remaining face-down cards of the second poker hand to complete the first and second poker hands;

determining which one of the similarly positioned face-down card and the duplicate hold card can improve the second poker hand;

if the similarly positioned face-down card can improve the second poker hand, using the similarly positioned face-down card to replace the duplicate hold card; and determining a poker hand ranking of resulting cards of each poker hand including the first poker hand, and the second poker hand that includes the similarly positioned face-down card.

2. The method of claim 1 wherein said determining which one of the similarly positioned face-down card and the duplicate hold card can improve the second poker hand is by obtaining a first ranking with said duplicate hold card and a second ranking with said similarly positioned face-down card; and comparing the first and second rankings to determine which is higher.

3. A method of playing multiple hands of video poker, said method including dealing a first poker hand having at least three cards that are dealt face-up and a second poker hand having at least three cards that are dealt face-down, wherein a hold card is selected from the first poker hand and duplicated into the second poker hand, wherein said duplicate hold card is placed over a corresponding face-down card of the second poker hand, wherein the corresponding face-down card is in a position corresponding to that of the hold card of the first poker hand, wherein non-held cards in the first hand are replaced to complete the first hand and remaining face-down cards of the second poker hand are turned face-up to complete the second poker hand, said method comprising:

determining whether the corresponding face-down card located under the duplicate hold card can improve a ranking of the second poker hand;

if said corresponding face-down card can improve the ranking of the second poker hand, using the corresponding face-down card to replace the duplicate hold card; and providing an award for the second poker hand based on the corresponding face-down card.

4. The method of claim 3 wherein said determining whether the corresponding face-down card can improve a ranking of the second poker hand is by using a pay table to obtain a first ranking with said duplicate hold card and a second ranking with said corresponding face-down car; and comparing the first and second rankings to determine which is higher.

5. The method of claim 3 wherein if said corresponding face-down card cannot improve the second poker hand, using the duplicate hold card to provide a primary award for the second poker hand; and using the corresponding face-down card to provide an additional secondary award.

6. The method of claim 3 wherein said determining whether the corresponding face-down card can improve a ranking of the second poker hand is based on a standard poker rankings determined before said multiple hands of video poker is initiated.

7. The method of claim 3 wherein the second poker hand is dealt from a standard 52-card deck wherein all cards dealt in the first poker hand are removed therefrom.

8. A method of playing video poker, said method having a primary poker hand and at least one secondary poker hand that are played contemporaneously, said secondary poker hand having at least one face-down card being at least partially covered by a face-up, duplicate hold card, said duplicate hold card being obtained by duplicating a hold card from the primary poker hand, said hold card and said duplicate hold card having corresponding positions in each respective poker hand, wherein upon completing both primary and secondary poker hands to have face-up cards, said method comprises:

selecting said face-down card to replace said duplicate hold card but only if a ranking of said secondary poker hand with said face-down card is higher than a ranking of said secondary poker hand with said duplicate hold card; and providing a payout award for the secondary poker hand based on the face-down card.

9. The method of claim 8 wherein rankings of said secondary poker hand are determined by using a pay table designated for the second poker hand.

10. The method of claim 8 further comprising designating a first pay table to the primary poker hand.

11. The method of claim 8 further comprising designating a second pay table, different from a first pay table, to the secondary poker hand.

12. The method of claim 8 further comprising receiving a first wager for the primary poker hand.

13. The method of claim 8 further comprising receiving a second separate wager for the secondary poker hand.

14. The method of claim 8 further comprising receiving a single wager for both the primary poker hand and the secondary poker hand.

15. A method by a video poker machine for playing video poker, said method comprising:

displaying at least two separate poker hands including a first poker hand having at least three cards that are face-up and a second poker hand having at least three cards that are face-down;

receiving a hold user-input signal to select a hold card from said first poker hand;

receiving a draw user-input signal to duplicate said hold card to provide a duplicate hold card that covers a corresponding positioned face-down card in the second poker hand, said draw user-input signal also providing replacement cards to replace non-held cards of the first poker hand to complete the first poker hand and to turn face-up remaining face-down cards of the second poker hand to complete the second poker hand;

determining which one of the corresponding positioned face-down card and the duplicate hold card can improve the second poker hand;

using the corresponding positioned face-down card to replace the duplicate hold card if the correspondingly positioned face-down card can improve the second poker hand; and providing a payout award for the second poker hand based on the face-down card.

16. The method of claim 15 wherein determining which one of the corresponding positioned face-down card and the duplicate hold card can improve the second hand is by determining a first ranking of said second poker hand with the corresponding positioned face-down card;

determining a second ranking of said second poker hand with the duplicate hold card;

comparing said first and said second ranking to determine which ranking is higher.

17. The method of claim 16 further comprising associating a first pay table with said first poker hand and associating a second pay table, different from a first pay table, with said second poker hand.

18. A video poker machine having a display device, an input device and a computer processor, said video poker machine comprising:

a display device;

an input device; and a computer processor configured with the display device and the input device to:

(1) display at least two separate poker hands including a first poker hand having at least three cards and a second poker hand having at least three cards;

(2) receive a hold user-input signal to select a hold card from said first poker hand;

(3) duplicate said hold card to provide a duplicate hold card that covers a corresponding positioned face-down card in the second poker hand;

(4) receive a draw user-input signal to provide replacement cards for non-held cards of the first poker hand to complete the first poker hand, and to turn over remaining face-down cards of the second poker hand face-up;

(5) determine which one of the corresponding positioned face-down card and the duplicate hold card can improve the second poker hand;

(6) use the corresponding positioned face-down card to replace the duplicate hold card if the corresponding positioned face-down card can improve the second hand; and (7) determine poker hand rankings of resulting cards of each poker hand and provide a payout award for the second poker hand based on the corresponding positioned face-down card.

19. The video poker machine of claim 18 wherein the computer processor is configured to: deal the second hand from a 52-card deck from which all cards dealt in the first poker hand are removed.

20. The method of claim 1 further comprising enabling a player to make a wager on each poker hand; and paying the player a pre-established amount based on the amount of the wager on each hand if the resulting cards of said hand comprise a predetermined poker hand ranking.

* * * * *